US005348208A

United States Patent [19]

Tamura

[11] Patent Number: 5,348,208

[45] Date of Patent: Sep. 20, 1994

[54] WIRE FEEDING AND MEASURING DEVICE

[75] Inventor: Yoshikazu Tamura, Kanagawa, Japan

[73] Assignee: Sumitomo Wiring Systems, Ltd., Mie, Japan

[21] Appl. No.: 87,276

[22] Filed: Jul. 8, 1993

[30] Foreign Application Priority Data

Jul. 8, 1992 [JP] Japan ..... 4-206045

[51] Int. Cl.[5] ..... B65H 51/10; H01B 13/00

[52] U.S. Cl. ..... 226/24; 226/32; 226/45

[58] Field of Search ..... 226/24, 32, 45, 4; 73/160

[56] References Cited

U.S. PATENT DOCUMENTS 4,192,207 3/1980 Bickford et al. ..... 226/4 X
4,638,558 1/1987 Eaton ..... 226/44 X
5,031,847 7/1991 Tanaka ..... 226/119

FOREIGN PATENT DOCUMENTS 61-203068 9/1986 Japan .

*Primary Examiner*—Andrew M. Falik
*Attorney, Agent, or Firm*—Oliff & Berridge

[57] ABSTRACT

A sensor is provided to measure the diameter of a wire, and a radius of curvature of the center of the core wire of the wire is found from the obtained wire diameter and the radius of a measuring roller. The number of revolutions of the measuring roller is determined according to the radius of curvature. An appropriate radius of curvature is found for each wire to be processed, and an accurate number of revolutions can be found irrespective of the type of wire. Accordingly, the wire feeding accuracy is improved, and the preparation work is simplified.

15 Claims, 15 Drawing Sheets

WIRE FEEDING AND MEASURING DEVICE

BACKGROUND OF THE INVENTION

1. Field of the Invention

The present invention relates to a wire feeding device for use in, for example, a harness manufacturing apparatus for manufacturing harnesses having a predetermined length.

2. Description of the Related Art

FIGS. 23 and 24 are schematic side views of a conventional harness manufacturing apparatus. By this harness manufacturing apparatus, a wire 30 intermittently fed by a wire feeding device A is subjected to various processing described later, so that harnesses of predetermined length, at both ends of which terminals 52 are press-clamped, are successively manufactured. This harness manufacturing apparatus includes the wire feeding device A, draw roller 11, front side clamp 12, cutter group 13, and rear side clamp 14.

A measuring roller 1 and feeding roller 2 are rotatably connected to the wire feeding device A, and both rollers 1 and 2 are arranged such that they can be rotated through a power transmission mechanism (not shown) in the same direction by the same amount of rotation synchronously with each other. A presser roller 4 pushed to a side of measuring roller 1 by a spring 3 is provided close to measuring roller 1. Spring 3 and presser roller 4 are also provided for a side of feeding roller 2.

As shown in FIG. 25, this harness manufacturing apparatus is provided with not only a roller drive device 22 to drive measuring roller 1 but also another drive device 23 to drive draw roller 11, clamps 12 and 14, cutter group 13 and the like, respectively. A control apparatus 20 to control these drive devices 22 and 23, and an input device 31 to input various commands and information to control apparatus 20 are provided.

A covered wire 30 pulled out from a stock reel (not shown) is inserted between measuring roller 1 and presser roller 4 and wound around measuring roller 1 and feeding roller 2. Wire 30 wound around measuring roller 1 and feeding roller 2 forms an S-shape. Covered wire 30 is then inserted between draw rollers 11, front side clamps 12, cutters 13, and rear side clamps 14, respectively.

After wire 30 has been set in the aforementioned manner, the information of predetermined length (a wire feeding amount) is inputted into control apparatus 20 through input device 31, so that an operation start command is given to control apparatus 20. Then wire 30 is held by both clamps 12 and 14, and group cutters 13 are synchronously operated. As a result of the foregoing, wire 30 is cut by a disconnecting cutter **13*a* disposed in the center of cutter group 13, and at the same time outer circumferential covered portions of wire 30 are notched by notching cutters 13*b* provided on both sides of the cutter group 13. When front side clamp 12 is moved under the aforementioned notched condition of wire 30, wire 30 held by clamp 12 (this wire 30 will be referred to as "a residual wire 30", hereinafter) is moved in the direction of arrow Q in the drawing. As a result, the covered portion at the end of residual wire 30 is peeled. Rear side clamp 14 is concurrently moved in the direction of arrow P, so that the covered portion at the end of the wire 30 held by clamp 14 (this wire 30 will be referred to as "a cut wire 30**", hereinafter) is peeled.

Successively, residual wire 30 is moved in a direction perpendicular to the surface of FIG. 23 together with front side clamp 12, and a terminal 52 (shown in FIG. 24) is press clamped to the peeled end portion of residual wire 30 by a terminal press-clamping device (not shown). Front side clamp 12 then returns to the initial position.

On the other hand, rear side clamp 14 is moved in a direction perpendicular to the surface of FIG. 23, and a terminal is press clamped to the peeled portion of cut wire 30 by a terminal press-clamping device (not shown). Then, rear side clamp 14 discharges cut wire 30 to a predetermined discharge position and returns to the initial position.

After both clamps 12 and 14 have been released, measuring roller 1 and feeding roller 2 are rotated by a predetermined number of revolutions so that wire 30 is fed to the draw roller 11 side by a feeding amount corresponding to the predetermined cutting length. After the wire feeding motion, draw roller 11 is rotated so that wire 30 is sent to the rear clamp 14 side as shown in FIG. 23.

After a one-cycle operation has been completed in this manner, the aforementioned motions are repeatedly carried out so that cut wires (harnesses), in which terminals 52 are press clamped to the peeled end portions, are successively manufactured.

As shown in FIG. 26, a relation between the number of revolutions of measuring roller 1 and the substantial feeding amount of wire 30 per one cycle is expressed by the equation $L_r=2\pi R_{30}X$ where the number of revolutions of measuring roller 1 is X, the substantial feeding amount of wire 30 is $L_r$, and the radius of curvature of the core wire center $C_{30}$ of wire 30 wound around measuring roller 1 is $R_{30}$.

On the other hand, in the aforementioned harness manufacturing apparatus, the number of revolutions X of the measuring roller 1 is calculated in the following manner: the radius of curvature of the center of the wire, which is used as a reference radius and has been set in the wire feeding device A (this radius of curvature is referred to as "reference radius of curvature $R_s$", hereinafter), is determined from measured data; the reference radius of curvature $R_s$ is assumed to be the radius of curvature of all the wires to be processed, and the number of revolutions X is calculated in accordance with the reference radius of curvature $R_s$. That is, the number of revolutions X of measuring roller 1 is calculated according to the equation $L_h=2\pi R_sX$ where the predetermined cutting length (the feeding amount) inputted into control apparatus 20 is $L_h$, and measuring roller 1 is rotated by this feeding amount.

However, as shown by an imaginary line in FIG. 27, when a wire **30*a* is fed, the radius of curvature $R_{30a}$ of which is different from the reference radius of curvature $R_s$, in the case of the aforementioned wire feeding device A, the number of revolutions X is found from the equation $L_h=2\pi R_sX$). The substantial feeding amount $L_r$ of the wire fed by the number of revolutions X is $2\pi R_{30a}X$. As described above, the radius of curvature $R_s$ is different from $R_{30a}$. Therefore, the substantial feeding amount $L_r$ ($=2\pi R_{30a}X$) of wire 30** is different from the predetermined feeding amount $L_h$ ($=2\pi R_sX$). This difference causes a number of problems.

In the case where a wire is used, the diameter of which is larger than that of the reference radius of curvature $R_s$, the substantial feeding amount becomes larger than the predetermined feeding amount. On the other hand, when the diameter of the wire is smaller than that of the reference radius of curvature $R_s$, the substantial feeding amount becomes smaller than the predetermined feeding amount. Therefore, the feeding accuracy is deteriorated due to the difference of radius of curvature.

It is possible to correct the error caused between the predetermined feeding amount and the substantial feeding amount by the hand work of an operator using a trial-and-error method. However, it is necessary to conduct this correction work each time the type of wire is changed. As a result, the preparation work to change the type of wire is complicated.

SUMMARY OF THE INVENTION

The present invention has been achieved to solve the aforementioned problems of the prior art. It is an object of the present invention to provide a wire feeding device of high feeding accuracy in which the correction work is not necessary and the preparation work is simple when the kind of wire is changed.

The above and other objects of the present invention can be achieved by providing a wire feeding device in which a measuring roller is driven so as to feed a covered wire under the condition that the covered wire is wound around the measuring roller. The wire feeding device includes an input device to input a feeding amount of the covered wire; a sensor to measure a diameter of the covered wire; and a control apparatus to control the rotation of the measuring roller so that the measuring roller can be rotated by a number of revolutions determined by a radius of curvature of the center of the covered wire wound around the measuring roller and also determined by a feeding amount inputted into the input device. The radius of curvature is found in accordance with a diameter of the covered wire measured by the sensor and also in accordance with a diameter of the measuring roller.

In the wire feeding device of the present invention, the diameter of a wire is measured, and the radius of curvature of the center of the wire is found from the measured diameter of the wire and the diameter of a measuring roller. The number of revolutions of the measuring roller is then determined in accordance with the radius of curvature. Therefore, an appropriate radius of curvature can be found for each wire to be processed, and an accurate number of revolutions of the measuring roller can be found irrespective of the type of wire. Moreover, the correction work for improving the feeding accuracy when the type of wire is changed is not necessary.

DETAILED DESCRIPTION OF PREFERRED EMBODIMENTS

Figure 1:
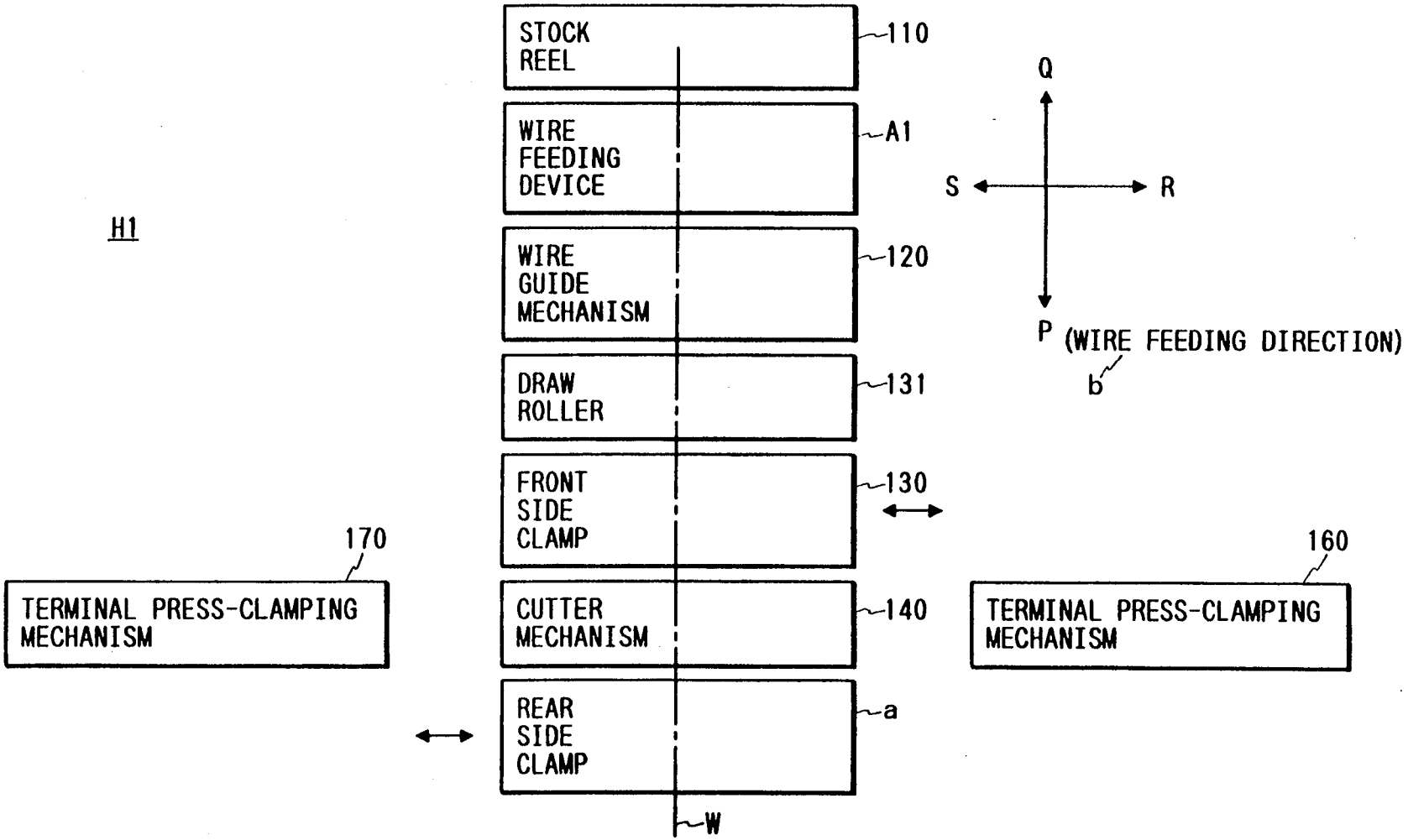
FIG. 1 is an arrangement plan view schematic of a harness manufacturing apparatus to which the wire feeding device of the first embodiment of the invention is applied.
Figure 2:
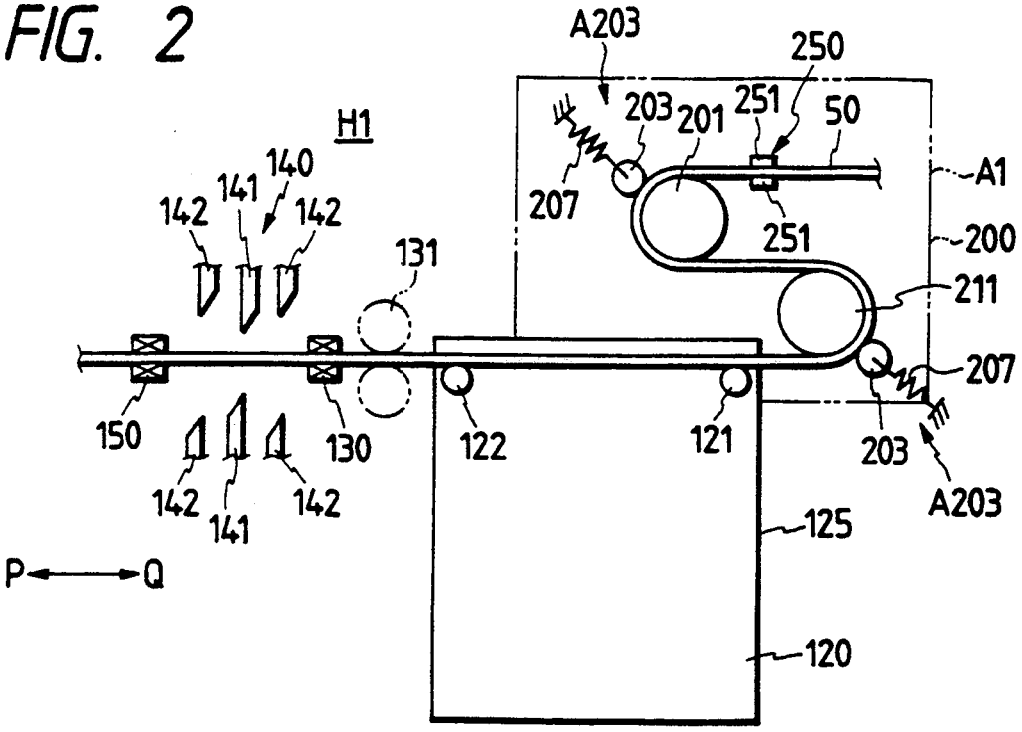
FIG. 2 is a side view of a model of the harness manufacturing apparatus of the first embodiment.
Figure 3:
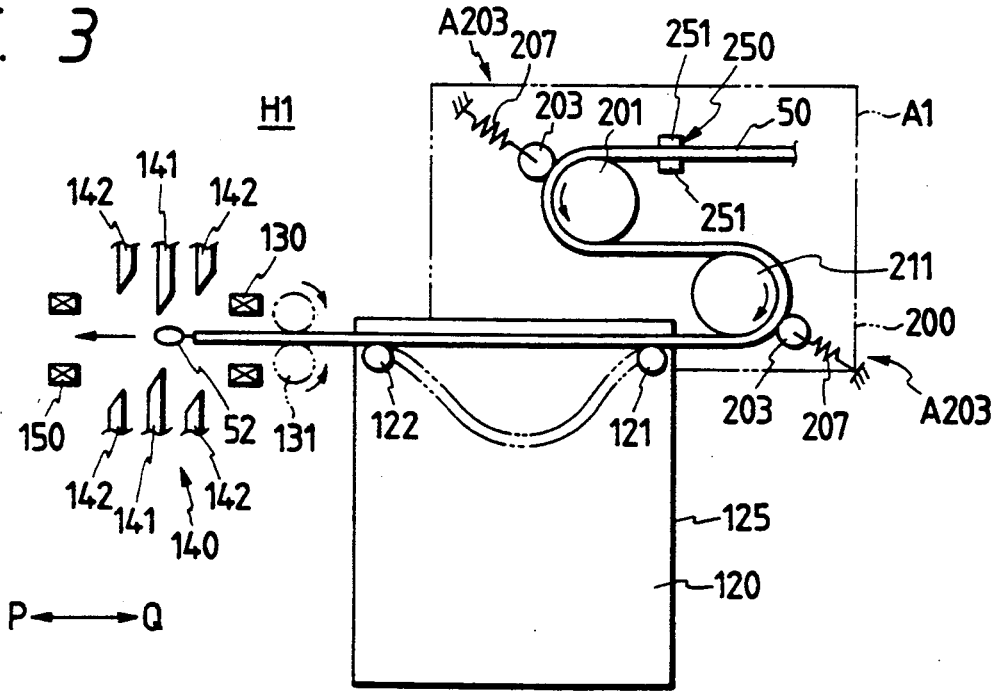
FIG. 3 is a side view of a model of the harness manufacturing apparatus of the first embodiment.
Figure 4:
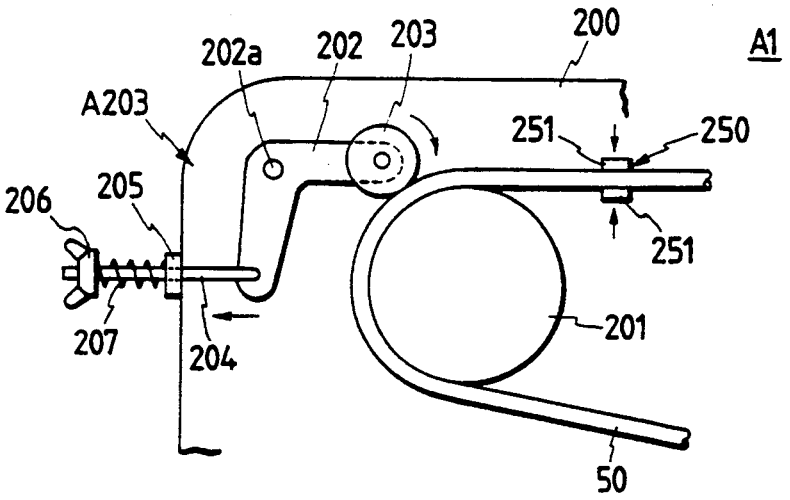
FIG. 4 is a schematic side view of a primary portion of the wire feeding device of the first embodiment.
Figure 5:
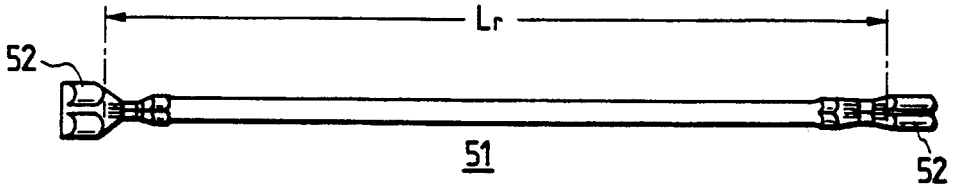
FIG. 5 is a plan view showing a harness manufactured by the harness manufacturing apparatus of the first embodiment.

FIG. 1 is a schematic plan view of a harness manufacturing apparatus H1 to which the wire feeding device A1 of the first embodiment of the invention is applied, FIGS. 2 and 3 are side views of a model of the harness manufacturing apparatus H1 of the first embodiment, and FIG. 4 is a side view showing a primary portion of the wire feeding device A1. As shown in the drawings, harness manufacturing apparatus H1 includes a stock reel 110, wire feeding device A1, wire guide mechanism 120, draw roller 131, front side clamp 130, cutter mechanism 140, and rear side clamp 150 that are disposed along a wire disposition line W. The harness manufacturing apparatus H1 includes terminal press-clamping mechanisms 160 and 170 disposed on the side of cutter mechanism 140. A covered wire 50 intermittently fed by the wire feeding device A1 successively passes through the wire feeding device A1, wire guide mechanism 120, draw roller 131, and front side clamp 130. Covered wire 50 is then subjected to various processing described later, and a harness 51, in which terminals 52 are press-clamped on both sides as shown in FIG. 5, is successively manufactured.

As shown in FIGS. 2 and 4, the wire feeding device A1 includes a measuring roller 201 and feeding roller 211 rotatably connected to a main body 200. Both rollers 201 and 211 are connected with each other through a power transmission mechanism (not shown). Feeding roller 211 is synchronized with measuring roller 201 and rotated in the same direction by the same amount of rotation.

As shown in FIG. 4, a wire pressing mechanism A203 is provided close to measuring roller 201 of main body 200. That is, a curved portion of an L-shaped oscillating arm 202 is rotatably provided through a shaft member 202*a*. A presser roller 203, freely contacted with and separated from measuring roller 201, is rotatably connected to one of the tip portions of oscillating arm 202, and a rod 204 is rotatably connected to the other tip portion of oscillating arm 202. Moreover, main body 200 is provided with a guide member 205 corresponding to rod 204, and rod 204 is slidably inserted into a hole of guide member 205. An end portion of rod 204 is engaged with an adjusting screw 206, and a compression spring 207 is provided between adjusting screw 206 and guide member 205. Rod 204 is pushed to the left in FIG. 4 by the extension force of compression spring 207 so that oscillating arm 202 is rotated clockwise in the drawing. As a result, presser roller 203 is pressed against measuring roller 201 by the resilient force of compression spring 207. The same wire pressing mechanism A203 is also provided on the feeding roller 211 side.

Wire 50 is wound around measuring roller 201 and feeding roller 211 forming an S-shape. Wire 50 is pressed against measuring roller 201 and feeding roller 211 by the resilient force of compression spring 207, and measuring roller 201 and feeding roller 211 are rotated by a roller drive means described later. Wire 50 is then fed longitudinally (along the wire disposition line W) in the direction of arrow P (referred to as "wire feeding direction P," hereinafter) by a feeding amount corresponding to the number of rotations of the measuring and feeding rollers.

In the wire feeding device A1, a contact type sensor 250 for measuring the diameter of wire 50 is provided corresponding to the wire disposition line W on the upstream side with respect to the wire feeding direction P of measuring roller 201. Sensor 250 is composed of a pair of detection members 251, 251 freely contacted with and separated from each other. The pair of detection members 251 pinch wire 50 so as to measure the diameter in a known manner.

As shown in FIGS. 2 and 3, in wire guide mechanism 120, two guide rollers 121 and 122 are rotatably provided, leaving a gap between the guide rollers and the upper end of main body 125. Wire 50 fed by the wire feeding device A1 is sagged between guide rollers 121 and 122 such that wire 50 is put in a waiting condition until it is fed by draw roller 131.

A pair of draw rollers 131 are freely contacted with and separated from each other, so that they can pinch the wire 50 on the wire disposition line W, and when the pair of draw rollers 131 are rotated in opposite directions, wire 50 is conveyed in the wire feeding direction P.

Front side clamp 130 is arranged such that it can freely hold and release wire 50 on the wire disposition line W and also such that it can freely move on a horizontal surface including the wire disposition line W.

Cutter mechanism 140 includes a pair of disconnecting cutters 141 to cut wire 50 on the wire disposition line W, and a pair of notching cutters 142, 142 to notch the covered portion on the outer circumference of wire 50, wherein notching cutters 142, 142 are disposed in the front and rear and both sides of disconnecting cutter 141. Moreover, cutter mechanism 140 is driven by a drive means described later such that cutters 141 and 142 are respectively opened and closed synchronously with each other.

Rear side clamp 150 is arranged to freely hold and release wire 50 on the wire disposition line W, and moreover, it can be freely moved on a horizontal surface including the wire disposition line W by a drive means described later.

Figure 6:
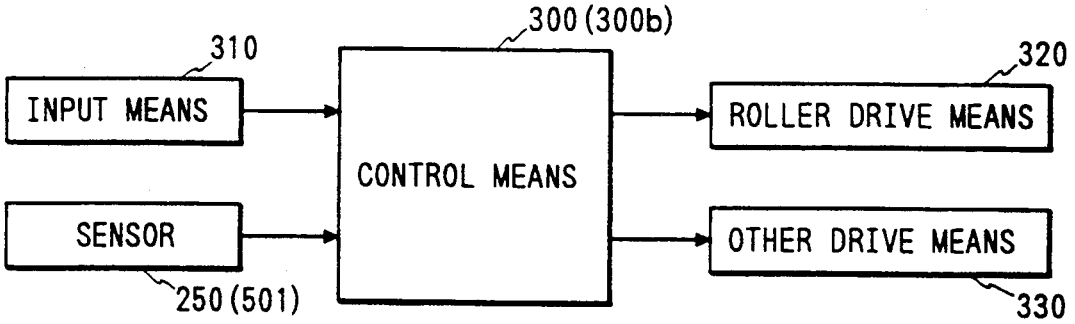
FIG. 6 is a view for explaining a control system of the harness manufacturing apparatus of the first embodiment.

As shown in FIG. 6, this harness manufacturing apparatus H1 includes a control means 300 and an input means 310 to input the information of predetermined wire cutting length (wire feeding amount) and the operation start command into control means 300. Moreover, a sensor 250 is connected with control means 300, so that control means 300 is capable of detecting the diameter of wire 50 in accordance with an output signal sent from sensor 250. Moreover, this harness manufacturing apparatus H1 includes not only a roller drive means 320 to drive measuring roller 201 but also another drive means 330 to independently drive draw roller 131, clamps 130, 150, cutter mechanism 140, and terminal press-clamping mechanisms 160 and 170. Therefore, in response to the inputted information and command, control means 300 controls drive means 320 and 330, and the following operations are carried out.

Figure 7:
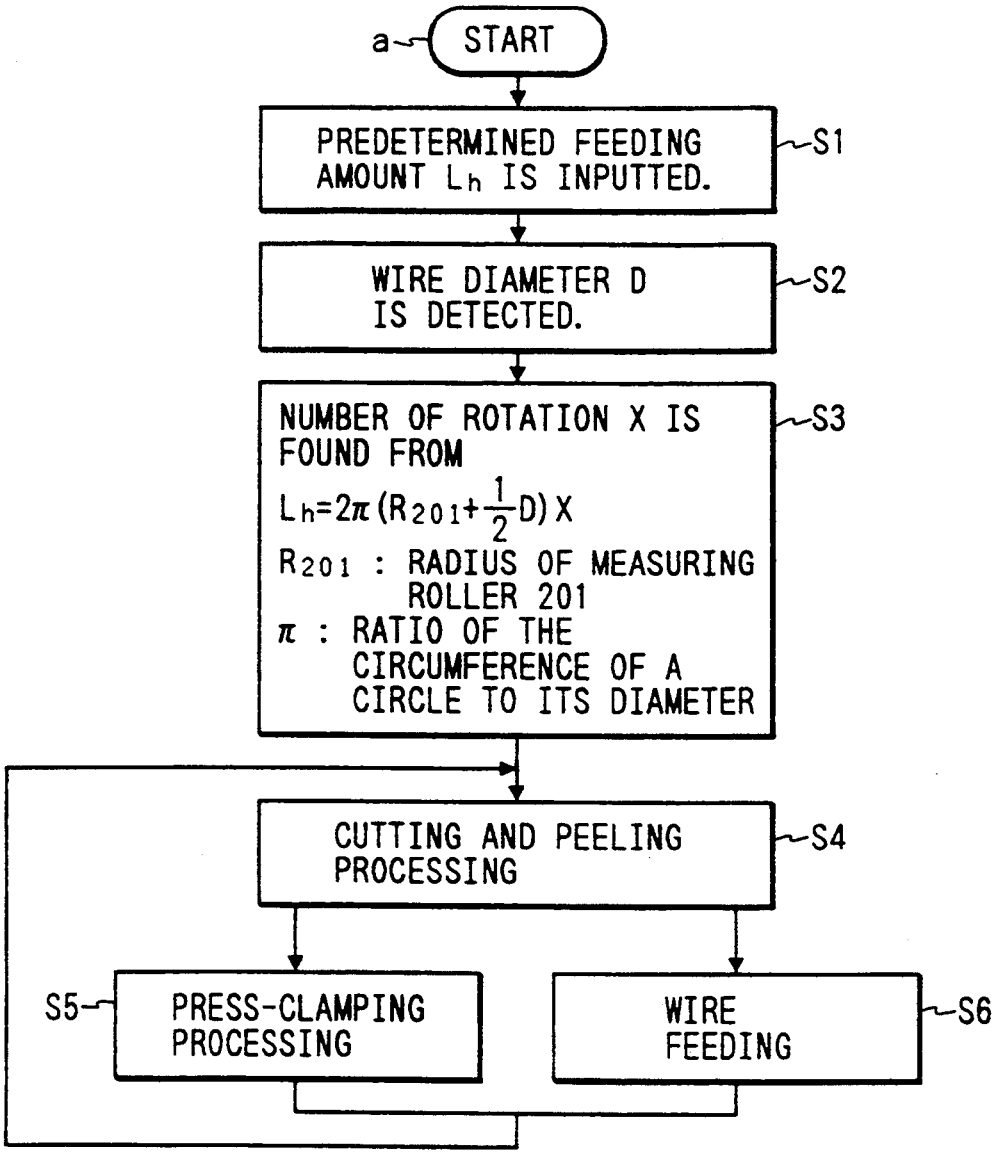
FIG. 7 is a flow chart for explaining an operation of the harness manufacturing apparatus of the first embodiment.

With reference to the flow chart shown in FIG. 7, an operation of the harness manufacturing apparatus will be explained as follows.

Before the start of the operation, wire 50 is set in the following manner: presser roller 203 of the wire feeding device A1 is raised, resisting the resilient force of compression spring 207, so that the presser roller 203 is separated from the surface of the measuring roller 201; wire 50 pulled out from stock reel 110 is inserted between presser roller 203 and measuring roller 201; and presser roller 203 is returned to the initial position so that wire 50 is held between presser roller 203 and measuring roller 201. Wire 50 is then wound around measuring roller 201 and feeding roller 211 such that wire 50 forms an S-shape. Wire 50 passes through two guide rollers 121 and 122 of wire guide mechanism 120. Moreover, wire 50 is made to pass between the pair of draw rollers 131, front side clamps 130, cutter mechanisms 140, and rear side clamps 150.

Under the aforementioned condition, as shown in step S1, the operator inputs a predetermined harness length (wire feeding amount) $L_h$ into the control means 300 through input means 310.

Figure 8:
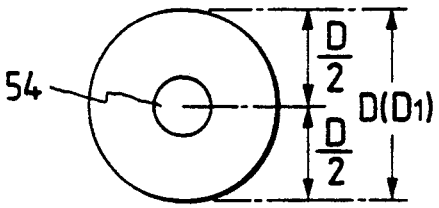
FIG. 8 is a sectional view of a wire processed by the harness manufacturing apparatus of the first embodiment.
Figure 9:
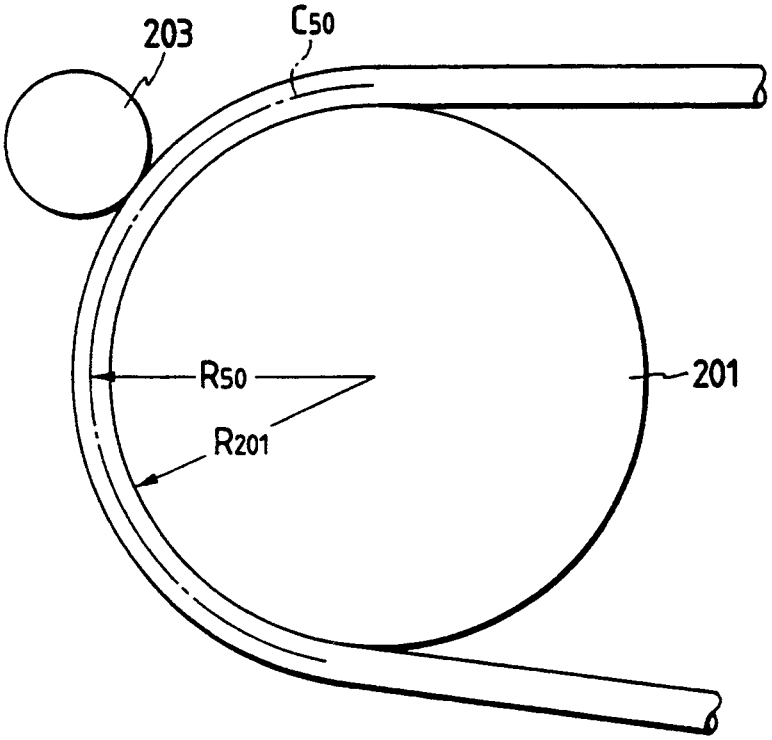
FIG. 9 is an enlarged side view of a primary portion of the harness manufacturing apparatus of the first embodiment.

An operation start command is given to the control means 300 through input means 310. Then, as shown in steps S2 and S3, control means 300 detects the diameter D of wire 50 (shown in FIG. 8) in accordance with a signal sent from sensor 250. Control means 300 includes a determining means that determines the number of revolutions X of measuring roller 201 per one cycle in accordance with the following equation (1).

$$L_h=2\pi(R_{201}+D/2)X \quad (1)$$

where $R_{201}$ is the radius of measuring roller 201 (shown in FIG. 9), and the value of $(R_{201}+D/2)$ in the equation is approximately equal to the radius of curvature $R_{50}$ of the center $C_{50}$ of the core wire portion 54 of wire 50.

Figure 23:
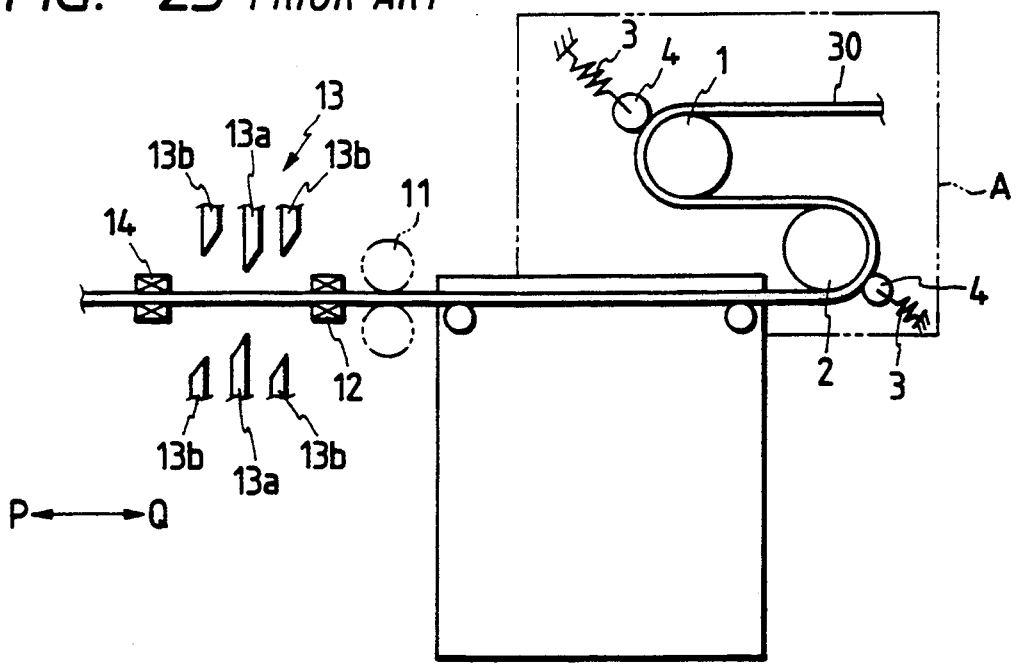
FIG. 23 PRIOR ART
FIG. 23 is a schematic side view of a conventional harness manufacturing apparatus.
Figure 24:
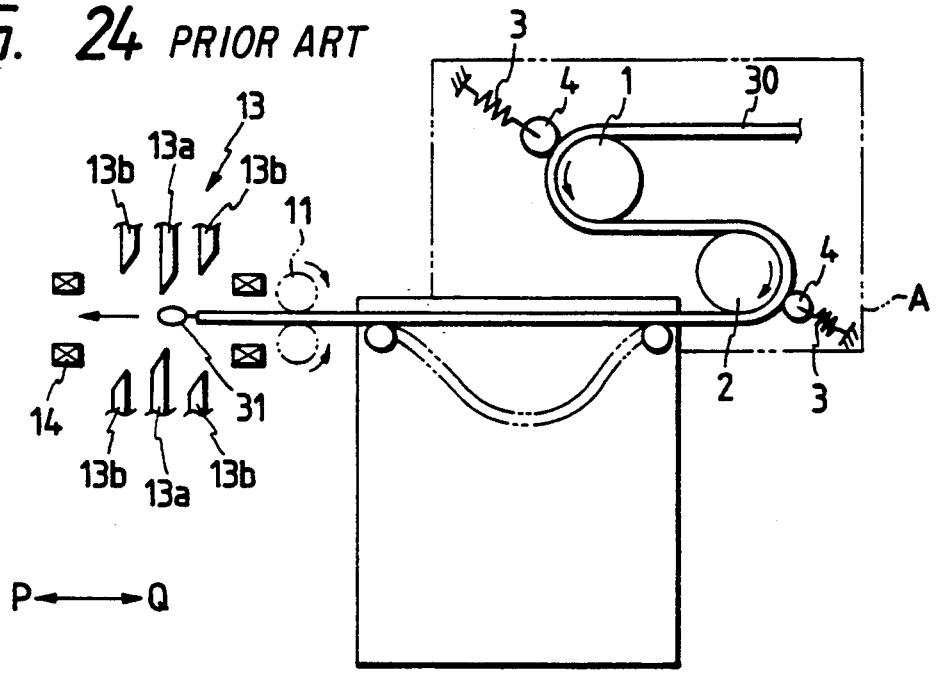
FIG. 24 PRIOR ART
FIG. 24 is a schematic side view of the conventional harness manufacturing apparatus.
Figure 26:
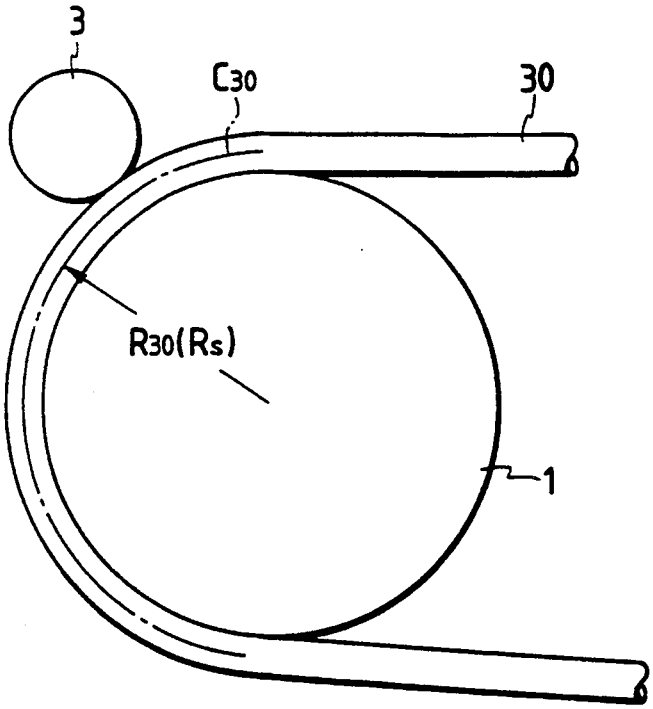
FIG. 26 PRIOR ART
FIG. 26 is an enlarged sectional view of a primary portion of the conventional harness manufacturing apparatus.
Figure 27:
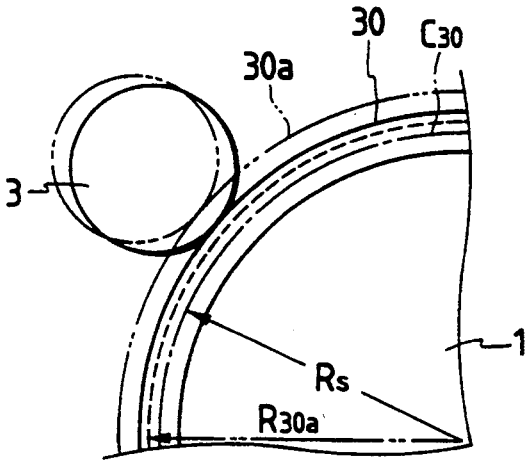
FIG. 27 PRIOR ART
FIG. 27 is a view for explaining the problems caused in the conventional harness manufacturing apparatus.

Next, as shown in step S4, similar to the conventional operation as shown in FIGS. 23 and 24, wire 50 is held by front side clamp 130 and rear side clamp 150, and then disconnecting cutter 141 and notching cutter 142 are synchronously operated, so that wire 50 is cut by disconnecting cutter 141, and, at the same time, the covered portion on the outer circumference of wire 50 is notched by notching cutter 142 on both sides of the cutting position. Under this notching condition, front side clamp 130 is moved in the direction Q opposite to the wire feeding direction P. Therefore, a covered portion of the end of wire 50 held by clamp 130 on the downstream side with respect to the wire feeding direction P (referred to as "residual wire 50", hereinafter) is peeled off. Rear side clamp 150 is moved in the direction of arrow P concurrently with the above motion, so that a covered portion of the end of wire 50 held by clamp 150 on the upstream side with respect to the wire feeding direction P (referred to as "cut wire 50", hereinafter) is peeled off (cutting and peeling processing).

Next, as shown in step S5, front side clamp 130 holding residual wire 50 is moved to the left indicated by the arrow R in FIG. 1 toward terminal press-clamping mechanism 160, and terminal 52 is press-clamped to the peeled portion of residual wire 50 by terminal press-clamping mechanism 160. After that, front side clamp 130 is moved to the right S, so that the residual wire 50 is disposed on the wire disposition line W. Rear side clamp 150 is moved to the right S toward terminal press-clamping mechanism 170 concurrently with the above motion, so that terminal 52 is press-clamped to the peeled portion of cut wire 50. After that, rear side clamp 150 releases cut wire 50, and discharges cut wire 50 to a predetermined discharge position, and returns to the initial position on the wire disposition line W.

Next, in parallel with step S5, wire 50 is fed by measuring roller 201 in step S6. That is, roller drive means 320 is driven so that measuring roller 201 can be rotated by an amount of revolutions corresponding to the aforementioned number of rotation X. Feeding roller 211 is rotated in sync with measuring roller 201, and wire 50 is fed by a feeding amount corresponding to the number of revolutions of measuring roller 201 in the wire feeding direction W. The substantial feeding amount (cutting length) $L_r$ (shown in FIG. 5) of wire 50 is $2\pi R_{50}X$ where the radius of curvature of the center $C_{50}$ of the core wire of wire 50 is $R_{50}$. As described above, this radius of curvature $R_{50}$ is approximately equal to $(R_{201}+D/2)$. Therefore, the substantial feeding amount $L_r$ becomes approximately equal to the predetermined feeding amount $L_h$, so that wire 50 can be accurately fed by the feeding amount corresponding to the length of the cut wire.

Wire 50 is fed in the aforementioned manner and sagged between guide rollers 121 and 121 of wire guide mechanism 120 (shown in FIG. 3), and after the wire feeding operation, draw roller 131 is rotated, and wire 50 is conveyed to the rear clamp 150 side while the sag of the wire formed between guide rollers 121 and 122 is being removed.

After the one cycle operation has been completed in this manner, the program returns to step S4, and the above motions are repeatedly conducted so that harnesses 51 to which terminals 52 are press-clamped at both ends, are successively manufactured.

On the other hand, in the case where the type of wire 50 is changed, a new wire is set in the same manner as described above, and the same motions as shown in steps S1 to S6 are conducted.

According to this harness manufacturing apparatus H1, the wire diameter D is measured, and the radius of curvature of the center of the core wire of wire 50 is found from the measured wire diameter D and the radius $R_{201}$ of measuring roller 201, and the number of revolutions X of measuring roller 201 is determined in accordance with the radius of curvature. Consequently, an appropriate radius of curvature can be found for each wire to be processed, and an accurate number of revolutions can be found irrespective of the type of wire. Accordingly, the wire feeding accuracy can be improved. Moreover, the correction work to improve the wire feeding accuracy when the type of wire is changed is not necessary, so that the preparation work can be simplified.

Figure 10:
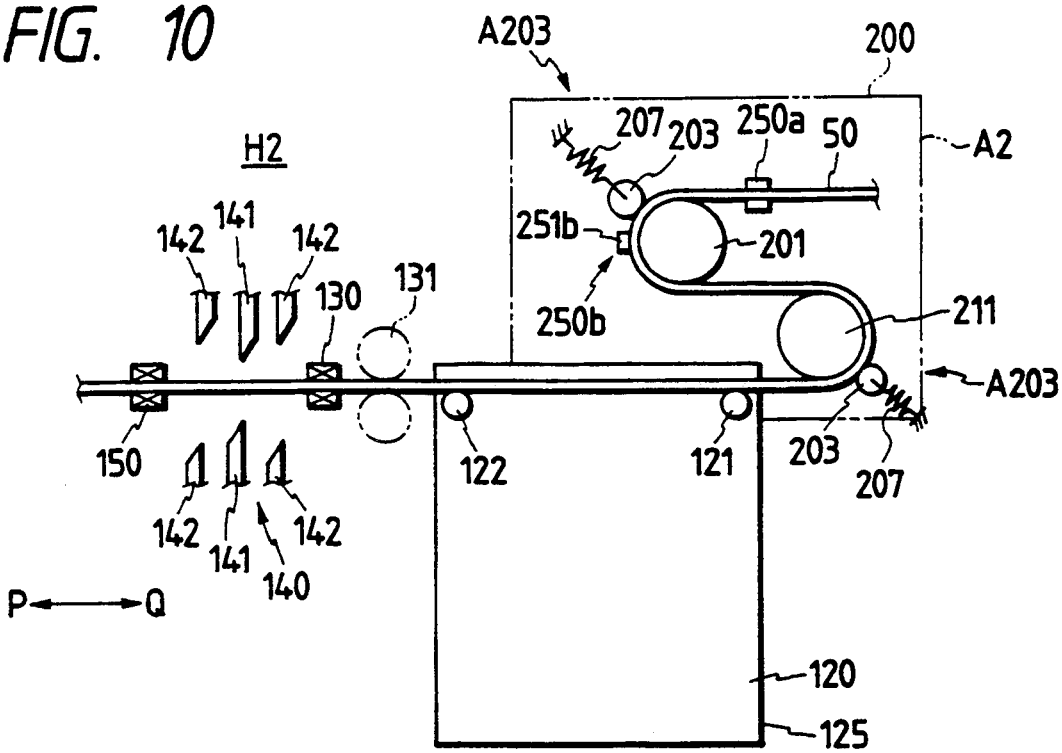
FIG. 10 is a side view of a model of a harness manufacturing apparatus to which the wire feeding device of the second embodiment of the invention is applied.
Figure 11:
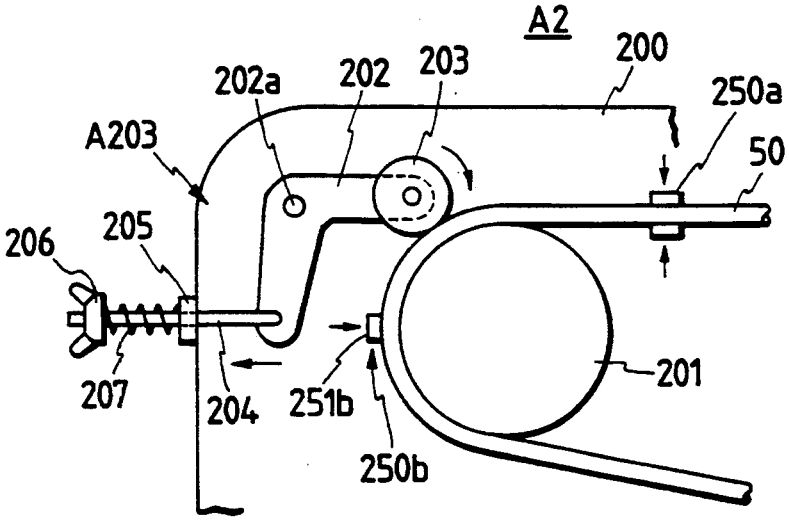
FIG. 11 is an enlarged side view of a primary portion of the harness manufacturing apparatus of the second embodiment.

FIG. 10 is a side view showing a model of a harness manufacturing apparatus H2 to which the wire feeding device A2 of a second embodiment of the invention is applied, and FIG. 11 is an enlarged side view showing a primary portion of the harness manufacturing apparatus H2. As shown in both drawings, in this harness manufacturing apparatus H2, a first contact type sensor **250*a* to measure the wire diameter in a normal condition is provided on the upstream side of measuring roller 201 with respect to the wire feeding direction P, and a second contact type sensor 250*b* to measure the wire diameter of wire 50 wound around measuring roller 201 is also provided. Second sensor 250*b* is provided with a detection body 251*b* capable of freely being contacted with and separated from wire 50. A signal about the position of detection body 251*b* with respect to the outer circumference of measuring roller 201 is outputted when this detection body 251*b* comes into contact with wire 50, that is, a signal about the position of detection body 251*b* is outputted under the condition that wire 50 is wound around the measuring roller 201**.

Figure 12:
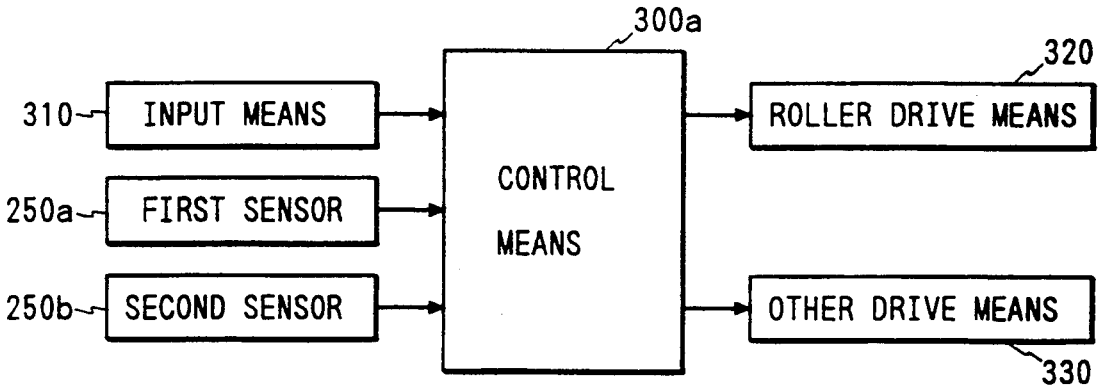
FIG. 12 is a view for explaining a control system of the harness manufacturing apparatus of the second embodiment.

As shown in FIG. 12, first and second sensors **250*a* and 250*b* are respectively connected with a control means 300*a*, so that control means 300*a* is capable of detecting the diameter of the wire in a normal condition and also in a wire winding condition in accordance with the output signals of sensors 250*a* and 250*b***.

The other structure of this embodiment is the same as that of the harness manufacturing apparatus H1 of the first embodiment.

Figure 13:
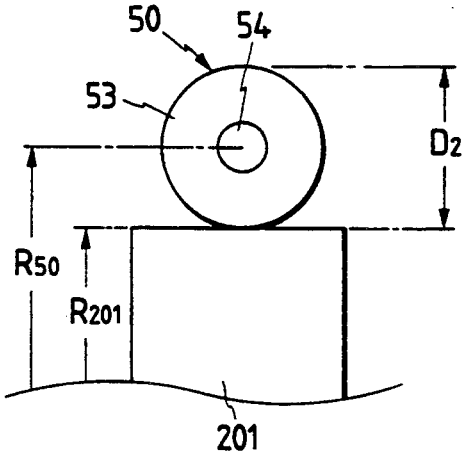
FIG. 13 is an enlarged view of a primary portion of the harness manufacturing apparatus of the second embodiment.
Figure 14:
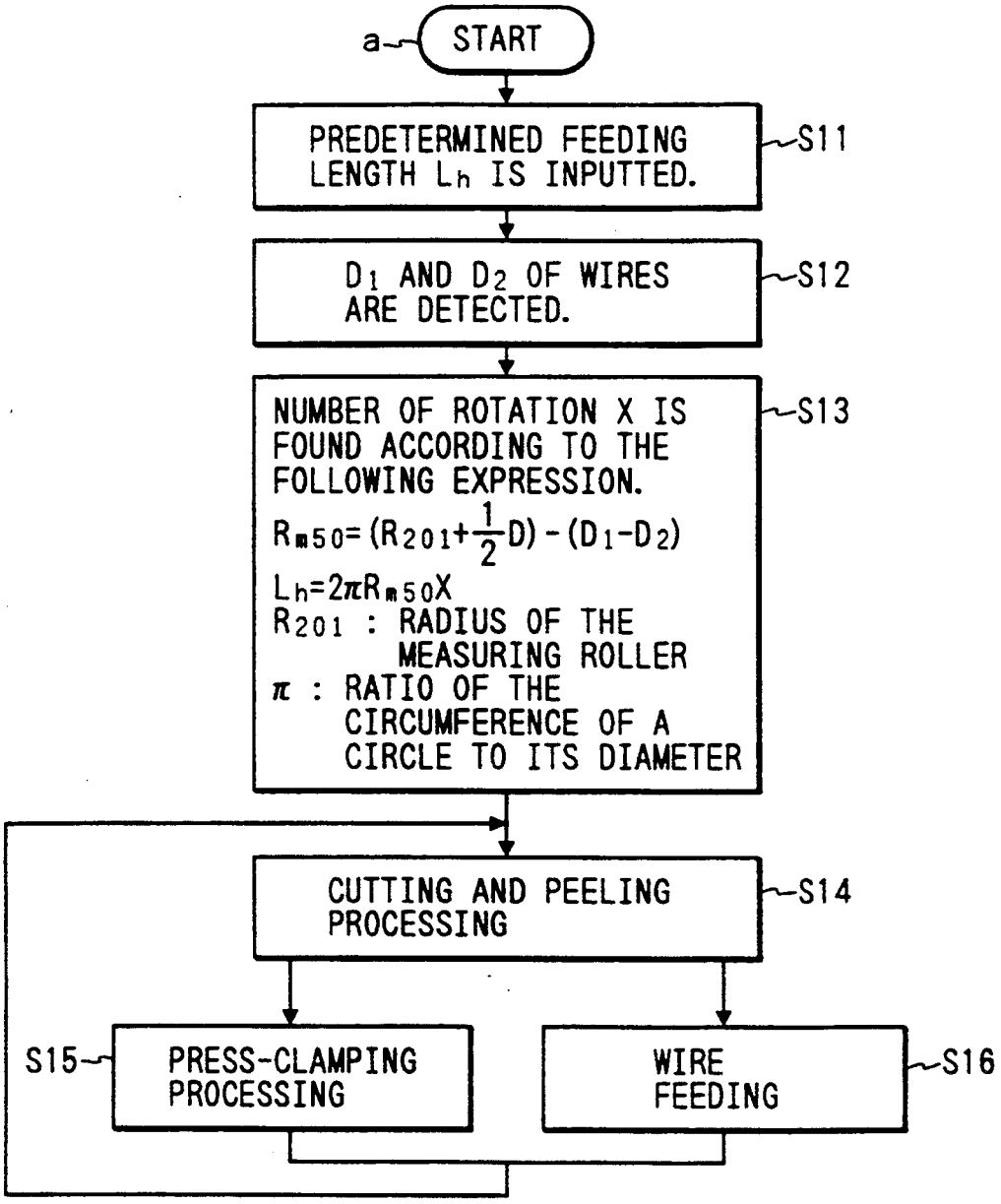
FIG. 14 is a flow chart for explaining an operation of the harness manufacturing apparatus of the second embodiment.

In this harness manufacturing apparatus H2, wire 50 is also set in the same manner as that of the first embodiment. In this case, as shown in FIG. 13, wire 50 wound around measuring roller 201 is pressed against the roller by the tension given to the wire so that the inner circumferential side of covered portion 53 is compressed. Therefore, the wire diameter D2 in a wire winding condition becomes smaller than the wire diameter D1 in a normal condition. (Refer to reference numerals having a parenthesis shown in FIG. 8.)

In the harness manufacturing apparatus H2, the number of revolutions X of measuring roller 201 is found as shown in steps S11 to S13 in the following manner. After a predetermined feeding amount $L_h$ has been inputted, the wire diameter $D_1$ in a normal condition and $D_2$ in a wire winding condition are respectively detected. When the wire diameters $D_1$ and $D_2$ are substituted into the following equations (2) and (3), the number of revolutions X of measuring roller 201 can be found.

$$R_{m50}=(R_{201}+D_1/2)-(D_1-D_2) \quad (2)$$

$$L_h=2\pi R_{m50X} \quad (3)$$

$R_{201}$ shown in equation (2) represents a radius of measuring roller 201. A radius of curvature of the center of the core wire of wire 50 can be found by $(R_{201}+D_1/2)$ under the condition that a compression amount of the covered portion 53 is not taken into consideration. When the compression amount $(D_1-D_2)$ is subtracted from the radius of curvature, a distance from the center of measuring roller 201 to the center of the core wire of wire 50 can be found, that is, the radius of curvature $R_{m50}$ of the center of the core wire of wire 50 can be found under the condition that the compression of the covered portion is taken into consideration. This radius of curvature $R_{m50}$ is very approximate to the substantial radius of curvature $R_{50}$, and the number of revolutions X is found from this radius of curvature $R_{m50}$.

As shown in steps S14 to S16, wire 50 is fed in accordance with the number of revolutions X, and the same operation as that of the first embodiment is carried out.

According to this harness manufacturing apparatus H2, the radius of curvature $R_{m50}$ is found under the condition that the compression amount of wire 50 wound around measuring roller 201 is taken into consideration, and the number of revolutions X of measuring roller 201 is determined. Therefore, a more appropriate radius of curvature than that of the first embodiment can be found, so that the wire feeding accuracy can be further improved.

Figure 15:
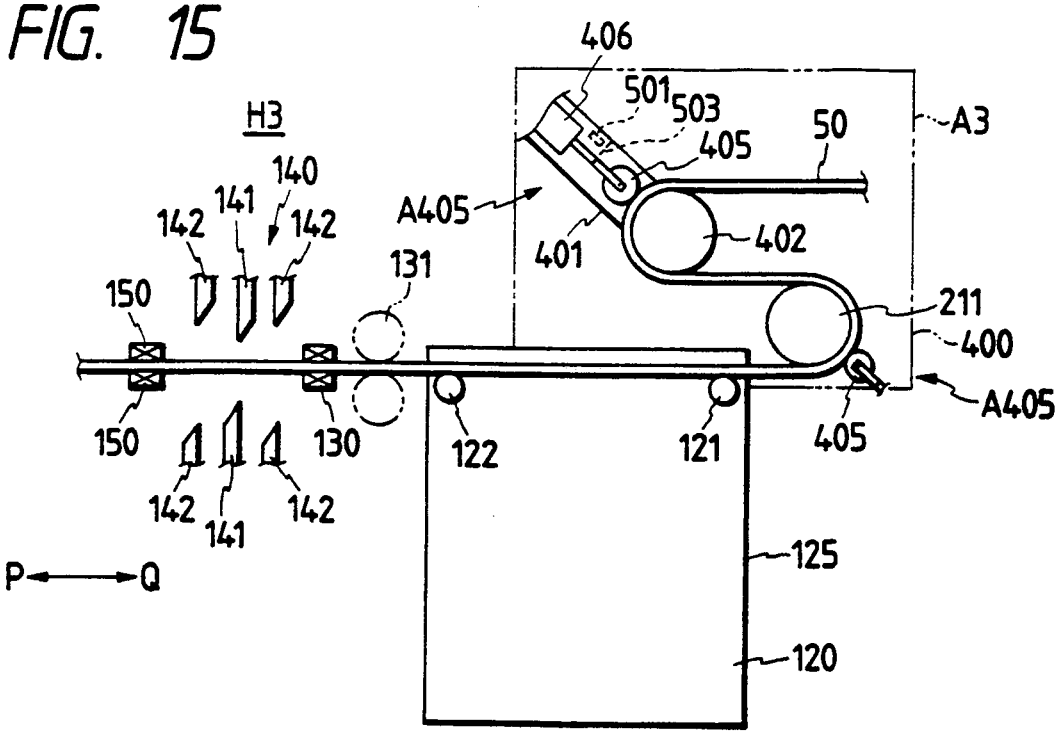
FIG. 15 is a side view of a model of a harness manufacturing apparatus to which the wire feeding device of the third embodiment of the invention is applied.
Figure 16:
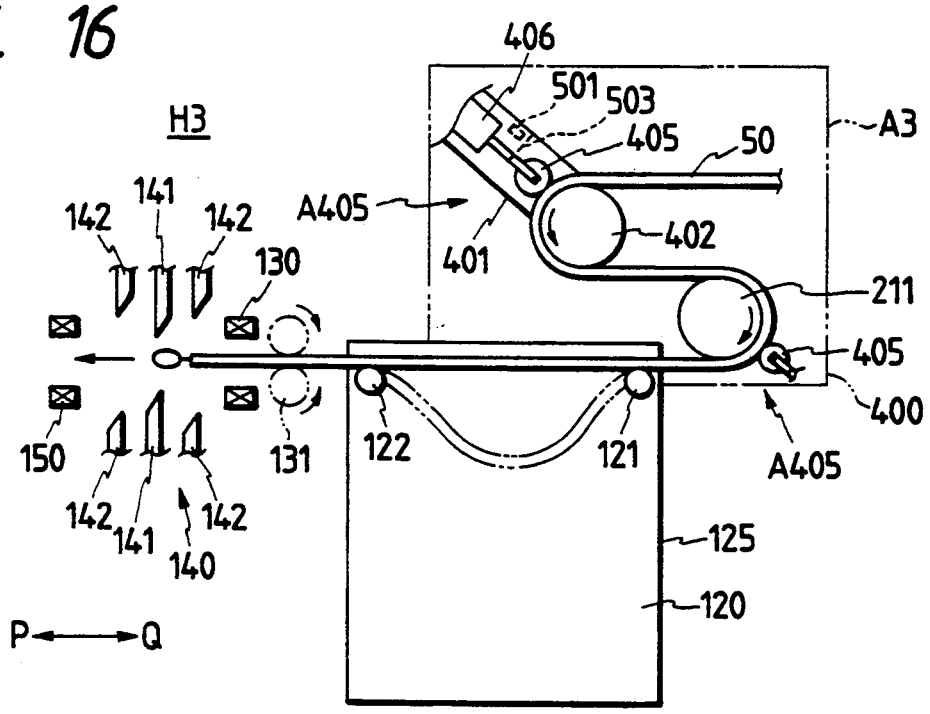
FIG. 16 is a side view of a model of the harness manufacturing apparatus of the third embodiment.
Figure 17:
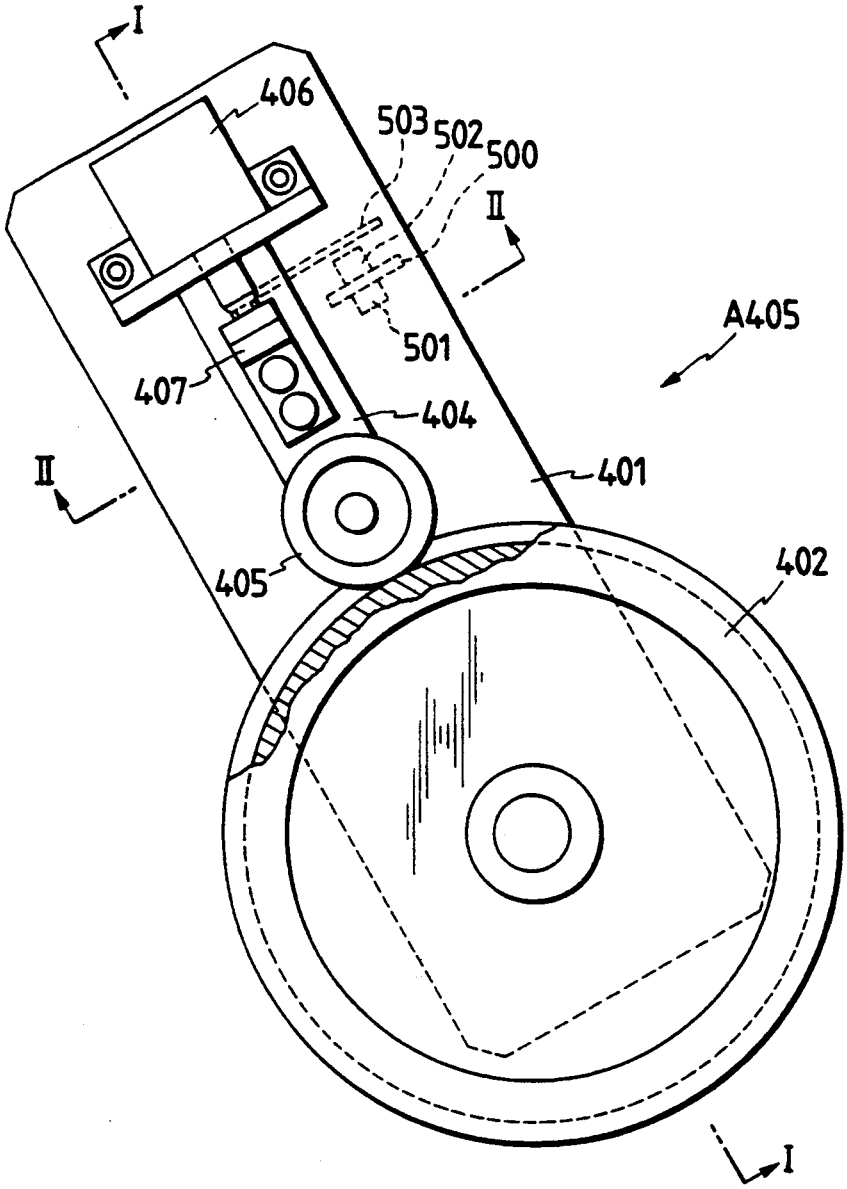
FIG. 17 is a plan view showing a primary portion of the harness manufacturing apparatus of the third embodiment.
Figure 18:
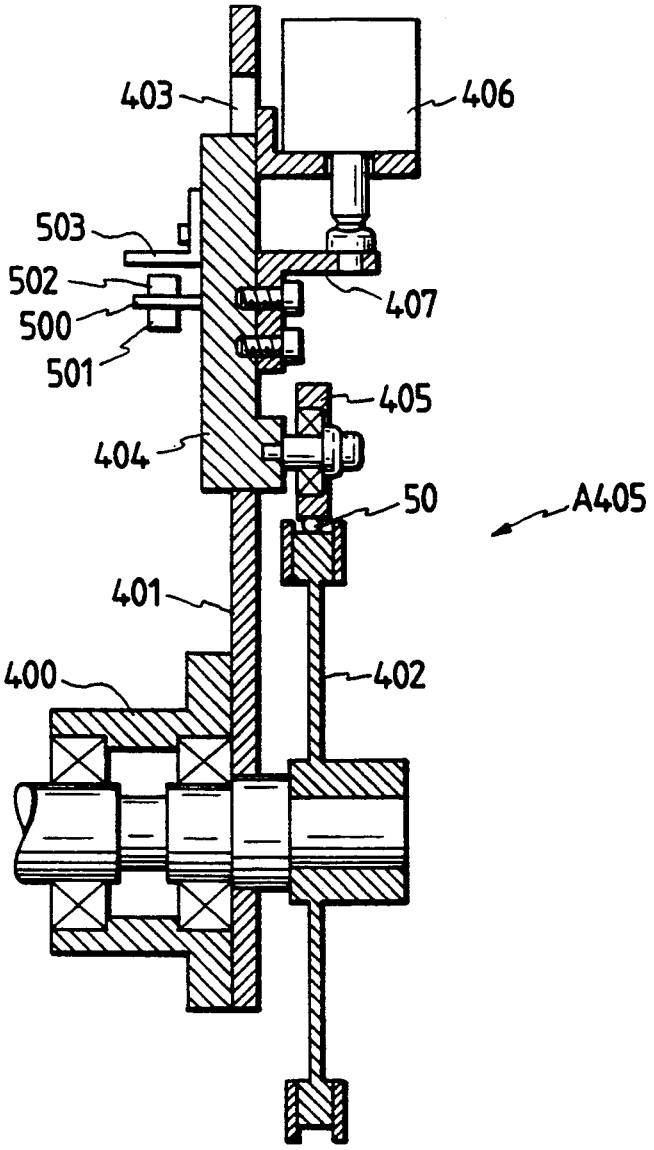
FIG. 18 is a sectional view taken on line I—I in FIG. 17.
Figure 19:
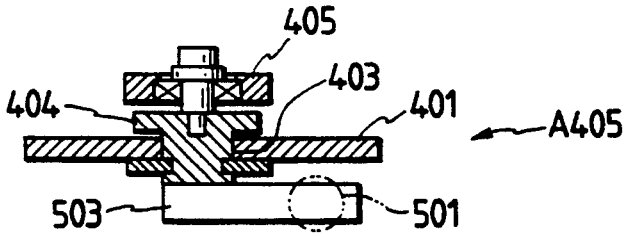
FIG. 19 is a sectional view taken on line II—II in FIG. 17.

FIGS. 15 and 16 are side views showing a model of a harness manufacturing apparatus H3 to which the wire feeding device A3 of a third embodiment of the invention is applied, and FIG. 17 is an enlarged side view showing a primary portion of the wire feeding device A3. FIG. 18 is a sectional view taken on line I—I in FIG. 17. FIG. 19 is a sectional view taken on line II—II in FIG. 17. As shown in these drawings, the wire feeding device A3 of this harness manufacturing apparatus H3 is provided with a wire pressing mechanism A405. That is, a base plate 401 is secured to a main body 400 of the wire feeding device A3, and a measuring roller 402 is rotatably connected to main body 400 through base plate 401. On base plate 401, a slit 403 is formed in a contacting and separating direction of measuring roller 402. A moving body 404 is slidably provided in slit 403 in the longitudinal direction of slit 403. A cylinder body of an air cylinder 406 is secured to base plate 401, and a tip of the piston rod is secured to moving body 404 through a bracket 407. Moreover, a presser roller 405 is rotatably connected to moving body 404. Therefore, when moving body 404 is slid by the drive force of air cylinder 406, presser roller 405 comes into contact with measuring roller 402. The same wire pressing mechanism A405 is also provided on the feeding roller 211 side, and both wire pressing mechanisms A405 and A405 are operated in the same manner described later.

A sensor head 502 of an eddy current type displacement sensor 501 is secured on the rear side of base plate 401 through a sensor mount plate 500 on the measuring roller 402 side in wire pressing mechanism A405. A metallic member 503 to be detected is attached to moving body 404 opposite sensor head 502. As a result, member 503 to be detected is contacted with or separated from sensor head 502 simultaneously when the presser roller 405 is contacted with or separated from measuring roller 402 so that a signal representing an amount of separation of presser roller 405 from measuring roller 402 can be outputted to a control means **300*b*. (Refer to a reference mark having a parenthesis in FIG. 6**.)

The other structure of this embodiment is the same as that of the embodiments described before.

In this harness manufacturing apparatus H3, output of sensor 501 is adjusted in the following manner: First, under the condition that presser roller 405 is contacted with measuring roller 402, output is adjusted so that an amount of separation becomes zero. Moreover, a thickness gauge is inserted between presser roller 405 and measuring roller 402, and the output is adjusted so that the amount of separation can be the same as the thickness of the gauge.

Figure 20:
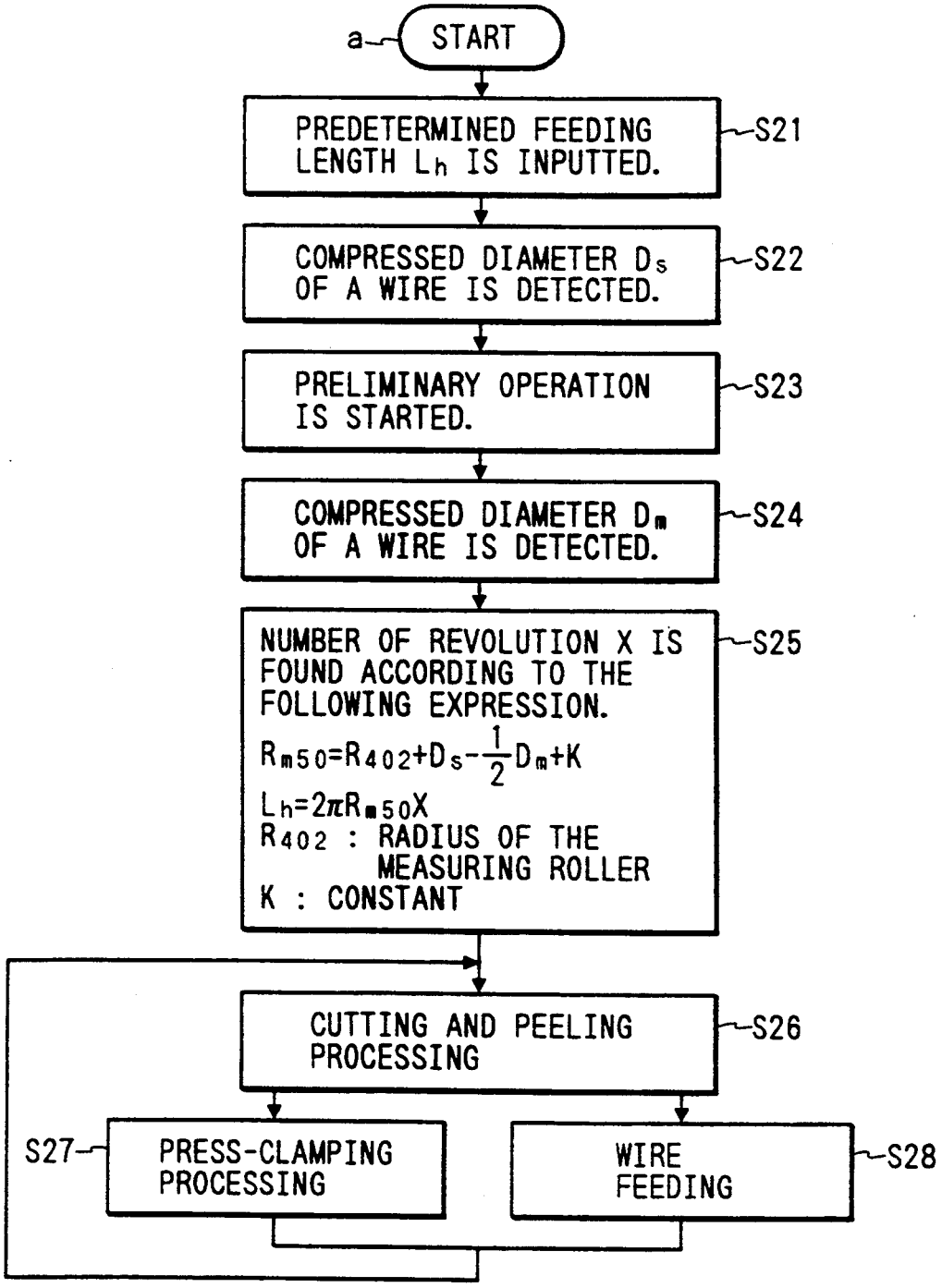
FIG. 20 is a flow chart for explaining an operation of the harness manufacturing apparatus of the third embodiment.
Figure 21:
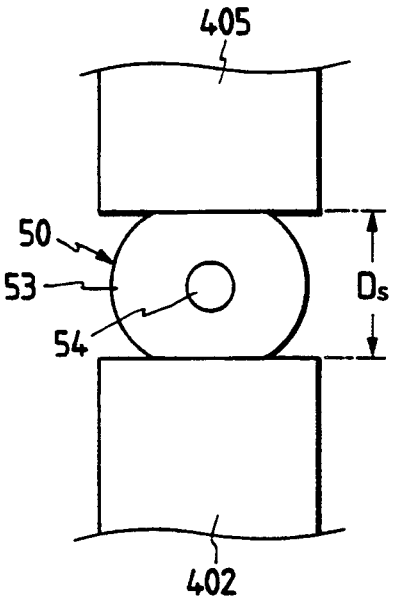
FIG. 21 is an enlarged view of a primary portion of the harness manufacturing apparatus of the third embodiment.

Wire 50 is then set in the device in the same manner as the embodiments described before while air cylinder 406 is withdrawn. Under the aforementioned condition, as shown in step S21 in FIG. 20, a predetermined feeding amount $L_h$ is inputted into control means **300*b* through input means 310, and successively an operation start command is given to control means 300*b*. Then, as shown in FIG. 21, air cylinder 406 advances so that wire 50 is held between presser roller 405 and measuring roller 402. At this time, wire 50 is pressed against measuring roller 402 through presser roller 405 by air cylinder 406, so that the wire is compressed. Successively, as shown in step S22, in accordance with an output signal sent from sensor 501, an amount of separation of presser roller 405 from measuring roller 402, that is, a compressed diameter $D_s$ of the wire (shown in FIG. 21**), can be detected.

Figure 22:
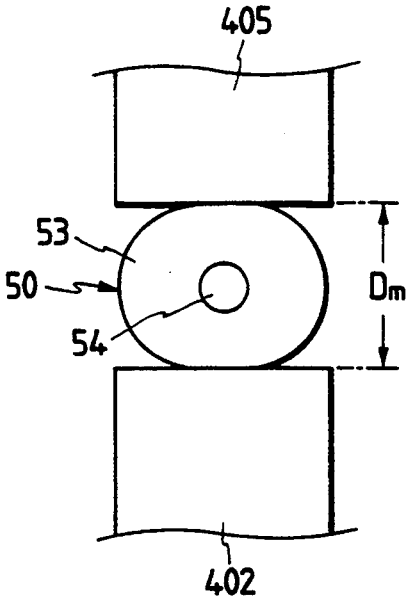
FIG. 22 is an enlarged view of a primary portion of the harness manufacturing apparatus of the third embodiment.
Figure 25:
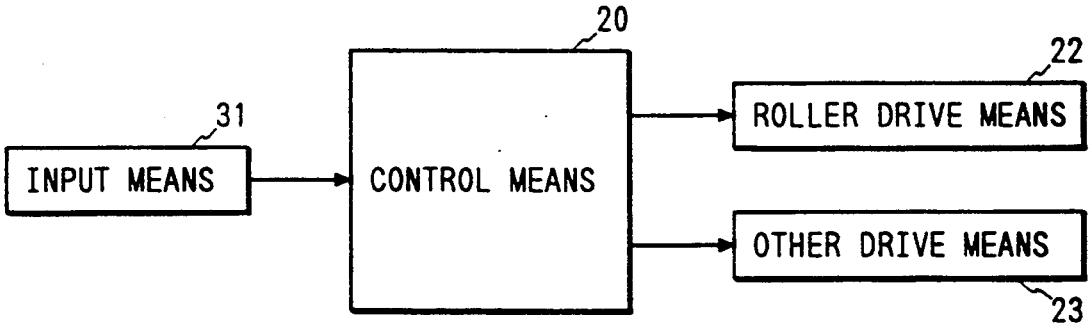
FIG. 25 PRIOR ART
FIG. 25 is a view for explaining a control system of the conventional harness manufacturing apparatus.

Next, as shown in step S23, a preliminary operation is started, and measuring roller 402 is rotated so that an appropriate length of wire 50 is fed. In this preliminary operation, clamps 130 and 150, and cutter mechanism 140 are set so that they can be appropriately operated. Under the aforementioned condition in which the wire 50 is fed, as shown in FIG. 22, an amount of separation of the presser roller 405 from measuring roller 402 (a compressed diameter $D_m$ of the wire) is detected in accordance with an output signal outputted from the sensor 501 (step S24). The compressed diameter $D_m$ of the wire during wire feeding is larger than the compressed diameter $D_s$ when wire feeding has been stopped.

Next, as shown in step S25, the radius of curvature $R_{m50}$ of the center of the core wire of wire 50 wound around measuring roller 402 is found in accordance with the following experimental equation (4).

$$R_{m50}=R_{402}+D_s-D_m/2+k \quad (4)$$

where $R_{402}$ is a radius of curvature of measuring roller 402, and k is a constant found from experimental data.

The number of revolutions X of measuring roller 402 is found in accordance with the following general equation (5), $$L_h=2\pi R_{m50}X \quad (5)$$

where $L_h$ is a predetermined feeding amount

Next, as shown in steps S26 to S28, a primary operation is started in accordance with this number of revolutions X, and the same operation as that described before is carried out.

The transition from the preliminary to the primary operation may be continuously conducted. Alternatively, it may be conducted after the operation has been temporarily stopped.

The radius of curvature $R_{m50}$ found by the experimental equation (4) in this harness manufacturing apparatus H3 is very close to the radius of curvature of wire 50. When the number of revolutions X of measuring roller 402 is determined from the radius of curvature $R_{m50}$, the feeding accuracy of wire 50 can be improved. Moreover, only a single sensor 501 is used in this embodiment. The number of sensors is reduced as compared with the second embodiment, and thus, the number of parts can be reduced.

In this embodiment, the presser roller 405 is pressed against measuring roller 402 by air cylinder 406, so that a constant pressing force can be maintained irrespective of the wire diameter. Accordingly, the pressing force adjustment work is not necessary for presser roller 405, and the preparation work for changing the wire is further simplified.

In the first and second embodiments, presser roller 203 is pressed against measuring roller 201 by compression spring 207, however, an air cylinder and other pushing means may be used instead of the compression spring.

As explained above, according to the wire feeding device of the present invention, the diameter of a wire is measured, and the radius of curvature of the center of the core wire is found from the diameter of the wire and that of the measuring roller, and then the number of revolutions of the measuring roller is determined in accordance with the obtained radius of curvature. Therefore, the following effects can be provided: An appropriate radius of curvature can be found for each wire to be fed so that an accurate number of revolutions of the measuring roller can be found irrespective of the type of wire. Consequently, the feeding accuracy can be improved. Moreover, when the type of wire is changed, a correction work to improve the feeding accuracy is not necessary, and the preparation work is simplified.

While the invention has been described with reference to the structure disclosed, it is not confined to the details set forth, but is intended to cover such modifications or changes as may come within the scope of the following claims.

What is claimed is:

1. A wire feeding device for feeding a covered wire wound around a measuring roller, the wire feeding device comprising:

input means for inputting a feeding amount of the covered wire;

sensor means for measuring a diameter of the covered wire; and control means connected to said input means and said sensor means comprising determining means for determining a number of revolutions for the measuring roller based on a radius of curvature of the center of the covered wire wound around the measuring roller and a feeding amount inputted by the input means, said determining means further determining the radius of curvature based on a diameter of the covered wire measured by the sensor and a diameter of the measuring roller, said control means for controlling the rotation of the measuring roller so that the measuring roller can be rotated by the number of revolutions determined by the determining means.

2. A wire feeding device according to claim 1, further comprising at least one wire pressing mechanism, said wire pressing mechanism comprising a support member, guiding means for guiding said pressing mechanism, and contacting means for contacting said covered wire, said support member supporting said guiding means and said contacting means.

3. A wire feeding device according to claim 2, wherein said support member has an L-shape with first and second ends and is pivotally supported at an intermediate portion, said guiding means being supported at said first end and said contacting means being supported at said second end.

4. A wire feeding device according to claim 3, wherein said measuring roller is rotatably connected to a main body, said guiding means comprising:

a rod pivotally connected at an inside end to said first end;

a guide member fixed to said main body and having a central aperture, said main body having a corresponding aperture, wherein said rod is disposed through said aperture in said guide member and said main body;

adjusting means disposed at an outside end of said rod for adjusting a contacting force of said contacting means; and a spring disposed between said guide member and said adjusting means, said spring urging said support member to pivot said contacting means against said covered wire.

5. A wire feeding device according to claim 4, wherein said adjusting means is an adjusting screw threadedly attached to said outside end of said rod.

6. A wire feeding device according to claim 3, wherein said contacting means comprises a presser roller rotatably connected to said second end of said support member, said presser roller being adapted to contact said covered wire and rotate with the feeding of said covered wire.

7. A wire feeding device according to claim 1, wherein said sensor means comprises at least one contact sensor having first and second detection members, said first and second detection members being disposed on opposite sides of said covered wire during feeding.

8. A wire feeding device according to claim 7, wherein said sensor means comprises a first contact sensor and a second contact sensor, said first contact sensor measuring the diameter of said covered wire in a normal condition, and said second contact sensor measuring the diameter of said covered wire in a winding condition, wherein said determining means further determines the radius of curvature of the covered wire based on the diameter of the covered wire in the normal condition and the winding condition.

9. A wire feeding device according to claim 1, wherein said sensor means comprises a wire pressing mechanism.

10. A wire feeding device according to claim 9, wherein said measuring roller is rotatably connected to a main body, said wire pressing mechanism comprising:

a base plate fixed to said main body, said base plate having a slot therein, wherein said measuring roller is rotatably connected to said main body through said base plate;

a moving body slidably disposed within said slot, said moving body having a first end and a second end;

a presser roller rotatably connected to said first end of said moving body, said presser roller adapted to contact said covered wire during feeding; and urging means fixed to said main body for urging said presser roller against said covered wire during feeding, said second end of said moving body being fixed to said urging means.

11. A wire feeding device according to claim 10, wherein said urging means comprises an air cylinder having a piston rod, said second end of said moving body being fixed to said piston rod.

12. A wire feeding device according to claim 10, wherein said sensor means further comprises a displacement sensor fixed to said base plate and a detection member fixed to said moving body, said detection member moving with said moving body into and out of contact with said displacement sensor, wherein said displacement sensor sends a signal representing an amount of separation of said presser roller from said measuring roller to said determining means.

13. A method of feeding a length of covered wire wound around a measuring roller, the wire feeding method comprising the steps of:

inputting a feeding amount of the covered wire;

measuring a diameter of the covered wire;

determining a number of revolutions for the measuring roller based on a radius of curvature of the center of the covered wire wound around the measuring roller and a feeding amount inputted in the inputting step, said determining step further comprising the step of determining the radius of curvature based on the diameter of the covered wire measured by the sensor and a diameter of the measuring roller; and controlling the rotation of the measuring roller so that the measuring roller can be rotated by the number of revolutions determined in the determining step.

14. A wire feeding method according to claim 13, wherein said measuring step further comprises the steps of measuring the diameter of the covered wire in a normal condition and measuring the diameter of the covered wire in a winding condition, said determining step determining the radius of curvature based on the diameter of the covered wire in the normal condition and the diameter of said covered wire in the winding condition.

15. A wire feeding device for feeding a covered wire wound around a measuring roller, the wire feeding device comprising:

an input for inputting a feeding amount of the covered wire;

a sensor measuring a diameter of the covered wire;

a determining mechanism for determining a number of revolutions for the measuring roller based on a radius of curvature of the center of the covered wire wound around the measuring roller and the feeding amount inputted by the input, said determining mechanism further determining the radius of curvature based on the diameter of the covered wire measured by the sensor and a diameter of the measuring roller; and a controller for controlling the rotation of the measuring roller so that the measuring roller can be rotated by the number of revolutions determined by the determining mechanism.

* * * * *